US011376491B2

(12) United States Patent
Tsai et al.

(10) Patent No.: US 11,376,491 B2
(45) Date of Patent: Jul. 5, 2022

(54) METHOD FOR OPERATING A CLAW MACHINE

(71) Applicant: Feiloli Electronic Co., Ltd., Changhua County (TW)

(72) Inventors: Chi-Ming Tsai, Hemei Town (TW); I-Chiang Yang, Hemei Town (TW)

(73) Assignee: Feiloli Electronic Co., Ltd., Hemei Town (TW)

( * ) Notice: Subject to any disclaimer, the term of this patent is extended or adjusted under 35 U.S.C. 154(b) by 142 days.

(21) Appl. No.: 17/029,194

(22) Filed: Sep. 23, 2020

(65) Prior Publication Data

US 2022/0088472 A1 Mar. 24, 2022

(51) Int. Cl.
*A63F 9/30* (2006.01)

(52) U.S. Cl.
CPC ..... *A63F 9/30* (2013.01)

(58) Field of Classification Search
CPC ..... A63F 9/30
See application file for complete search history.

(56) References Cited

U.S. PATENT DOCUMENTS

| | | | | |
|---|---|---|---|---|
| 5,855,374 | A * | 1/1999 | Shoemaker, Jr. | G07F 17/3297 273/447 |
| 9,526,978 | B1 * | 12/2016 | Shoemaker, Jr. | G07F 17/3251 |
| 11,011,029 | B1 * | 5/2021 | Shoemaker, Jr. | G07F 17/3297 |
| 11,164,428 | B1 * | 11/2021 | Shoemaker, Jr. | G07F 17/3297 |
| 2011/0115163 | A1 * | 5/2011 | Guarnieri | G07F 17/3297 273/448 |
| 2018/0330577 | A1 * | 11/2018 | Shoemaker, Jr. | G07F 17/3251 |
| 2020/0175822 | A1 * | 6/2020 | Kim | A63F 9/30 |
| 2020/0289918 | A1 * | 9/2020 | Shoemaker, Jr. | A63F 9/0079 |
| 2020/0306623 | A1 * | 10/2020 | Wei | A63F 9/30 |
| 2022/0088472 | A1 * | 3/2022 | Tsai | A63F 9/30 |

* cited by examiner

*Primary Examiner* — Raleigh W Chiu
(74) *Attorney, Agent, or Firm* — Alan D. Kamrath; Karin L. Williams; Mayer & Williams PC

(57) ABSTRACT

A claw machine includes a compartment for containing multiple prizes, a crane module movable in the compartment, a chute, a claw module, a turntable, a coin module, a control system, and an operation module including at least one joy stick and at least one button. In operation, the control system actuates the turntable module. A player is allowed to operate the joy stick and the button to move the crane module, to lift and lower the claw module relative to the crane module, to open and close the claw module to fetch a desired one of prizes, and to open the claw module to drop the desired prize onto the turntable module. The turntable module casts the desired prize toward the chute in a centrifugal manner.

5 Claims, 7 Drawing Sheets

METHOD FOR OPERATING A CLAW MACHINE

BACKGROUND OF INVENTION

1. Field of Invention

The present invention relates to a claw machine and, more particularly, to a method for operating a claw machine.

2. Related Prior Art

A typical claw machine includes a compartment, a crane module, a claw module, a coin module and an operation module. Multiple prizes are located in the compartment. The crane module and the claw module are in operation in the compartment. The coin module is used to receive at least one coin or token from a player and then wake up the claw machine from a stand-by mode. In a limited period of time, the user uses a joy stick and a button of the operation module to operate the crane module and the claw module to fetch a desired prize, move the desired prize to a location above a chute in communication with the compartment, and drop the desired prize into the chute. However, there is always a need for a new way of operating such a claw machine.

The present invention is therefore intended to obviate or at least alleviate the problems encountered in the prior art.

SUMMARY OF INVENTION

It is the primary objective of the present invention to provide a method for operating a claw machine including a compartment for containing multiple prizes, a crane module movable in the compartment, a chute for transporting the prizes out of the compartment, a claw module movable up and down relative to the crane module in the compartment, a turntable module located in the compartment, a coin module for receiving at least one coin, a control system for waking up the claw machine on receiving a signal from the coin module, and an operation module including at least one joy stick and at least one button.

To achieve the foregoing objective, the method including the step of using the control system to actuate the turntable module. Then, a player is allowed to operate the joy stick and the button to move the crane module, to lift and lower the claw module relative to the crane module, to open and close the claw module to fetch a desired one of prizes, and to open the claw module to drop the desired prize onto the turntable module. Then, the turntable module casts the desired prize toward the chute in a centrifugal manner.

Other objectives, advantages and features of the present invention will be apparent from the following description referring to the attached drawings.

BRIEF DESCRIPTION OF DRAWINGS

The present invention will be described via detailed illustration of three embodiments referring to the drawings wherein.

DETAILED DESCRIPTION OF PREFERRED EMBODIMENT

Figure 1:
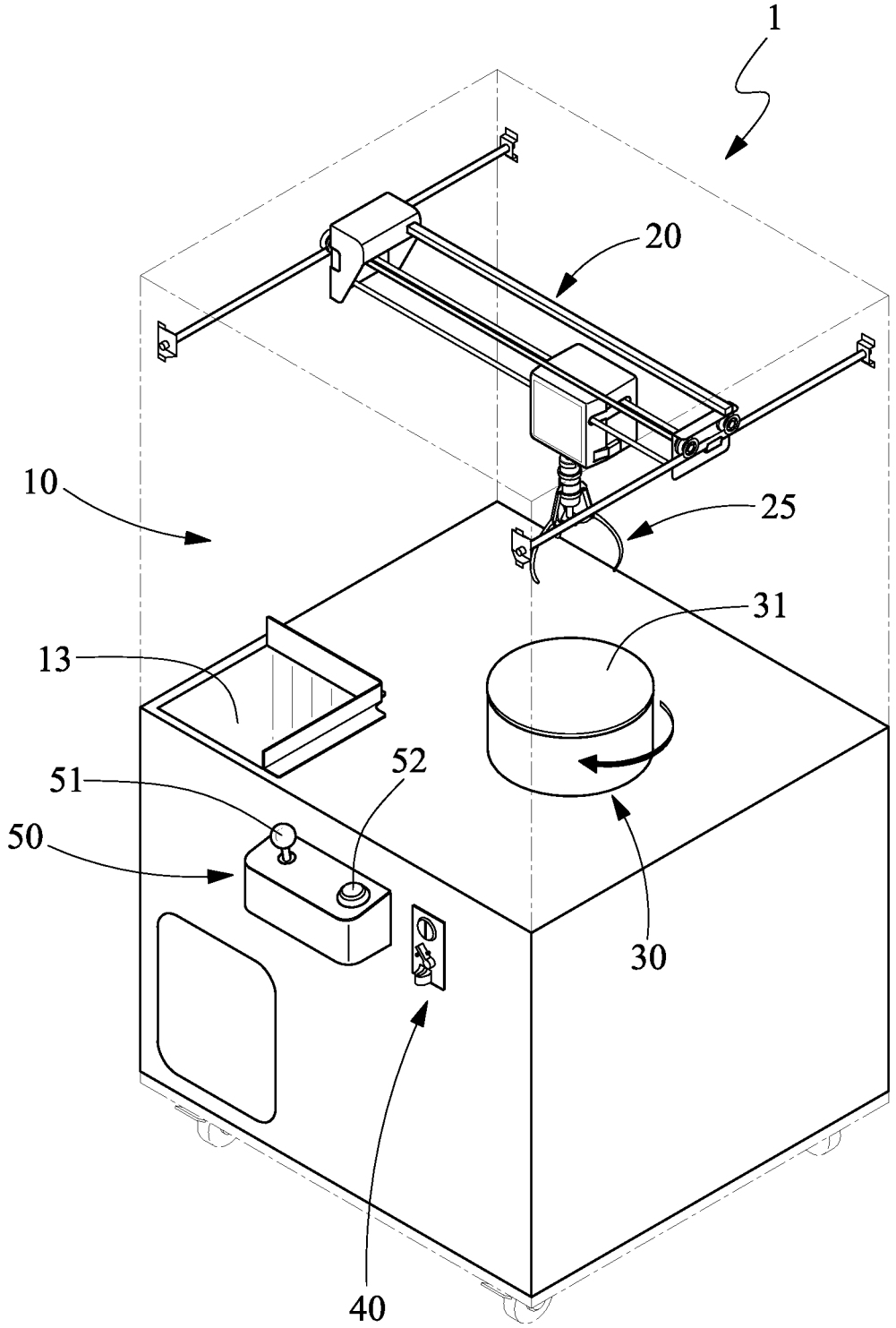
FIG. 1 is a perspective view of a claw machine according to the first embodiment of the present invention.
Figure 2:
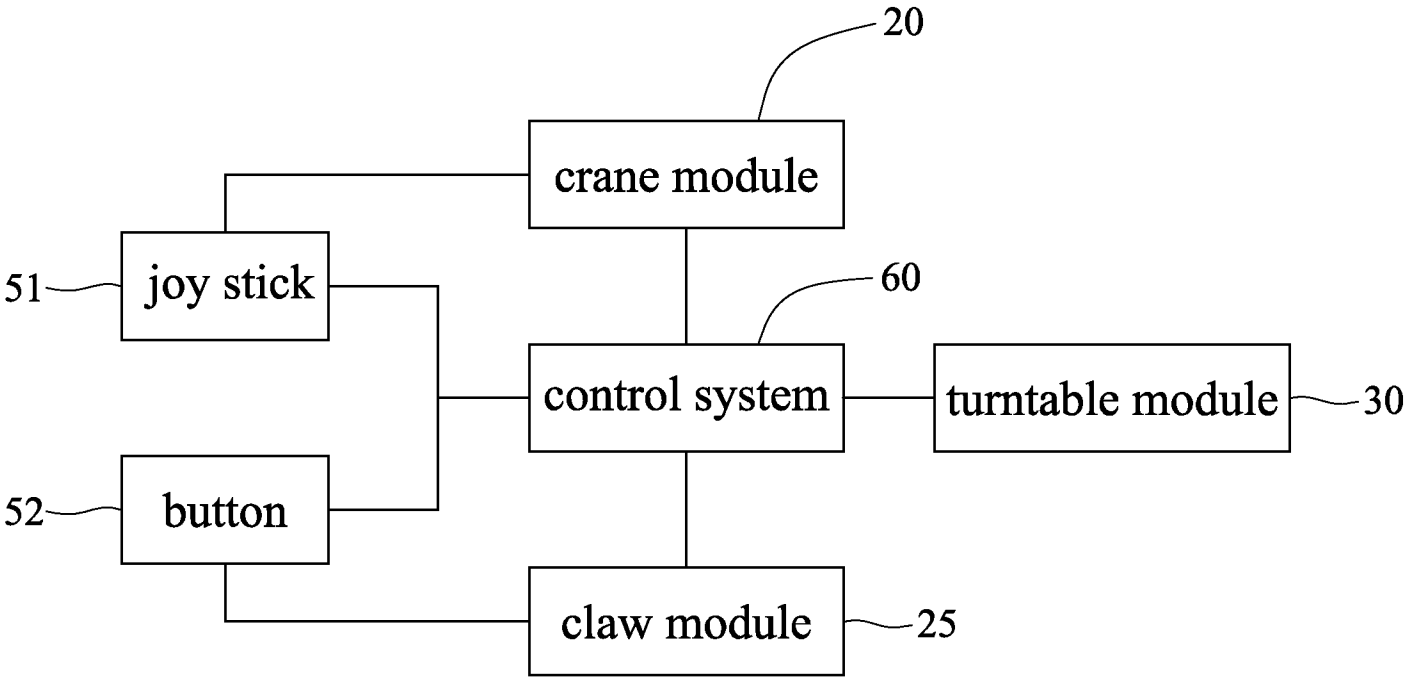
FIG. 2 is a block diagram of the claw machine shown in FIG. 1.

Referring to FIGS. 1 and 2, a claw machine 1 includes a compartment 10, a chute 13, a crane module 20, a claw module 25, a turntable module 30, a coin module 40, an operation module 50, and a control system 60 according to the preferred embodiment of the present invention. Multiple prizes 12 are located in the compartment 10. The chute 13 is in communication with the compartment 10. The prizes 12 can be moved from the compartment 10 through the chute 13. The crane module 20 is located in an upper portion of the compartment 10. The claw module 25 is carried by the crane module 20 so that the former is movable up and down relative to the latter. The turntable module 30 is located in a lower portion of the compartment 10. The operation module 50 includes at least one joy stick 51 and at least one button 52. The control system 60 is used to control the crane module 20, the claw module 25, the turntable module 30, the coin module 40 and the operation module 50.

In a first operation, the coin module 40 receives at least one coin or token from a player and then sends a signal to the control system 60. On receiving the signal from the coin module 40, the control system 60 wakes up the claw machine 1 from a stand-by mode.

The control system 60 actuates the turntable module 30 to rotate a turntable 31 at a constant or changing rate, in a first direction, a second direction or alternately the first and second directions. The joy stick 51 is used to move the crane module 20 in a plane. The button 52 is operated to lift or lower the claw module 25. Moreover, the button 52 is operated to open or close the claw module 25. In a predetermined period of time, the joy stick 51 and the button 52 are used to operate the crane module 10 and the claw module 25 to fetch a desired one of the prizes 12 and then drop the desired prize onto the turntable 31. The turntable 13 casts away the desired prize 12 in a centrifugal manner. The centrifugal cast of the desired prize 12 from the turntable 31 depends on the rate and direction of the rotation of the rotation of the turntable 31 and the size and center of gravity of the desired prize 12. The player can collect the desired prize 12 from the chute 13 if the desired prize 12 is cast into the chute 13.

To drop the desired prize 12 onto the turntable 31, when the claw module 25 fetches the desired prize 12, the control system 60 stops the operation module 50 from controlling the crane module 20 and the claw module 25. Instead, the control system 60 holds the crane module 20 still in a location and opens the claw module 25 to drop the desired prize 12 onto the turntable 31 in rotation. That is, the control system 60 controls the portion of the turntable 31 onto which the desired prize 12 is dropped. Thus, the control system 60 guarantees dropping of the desired prize 12 onto the turntable 31 in rotation to continue the game.

Figure 3:
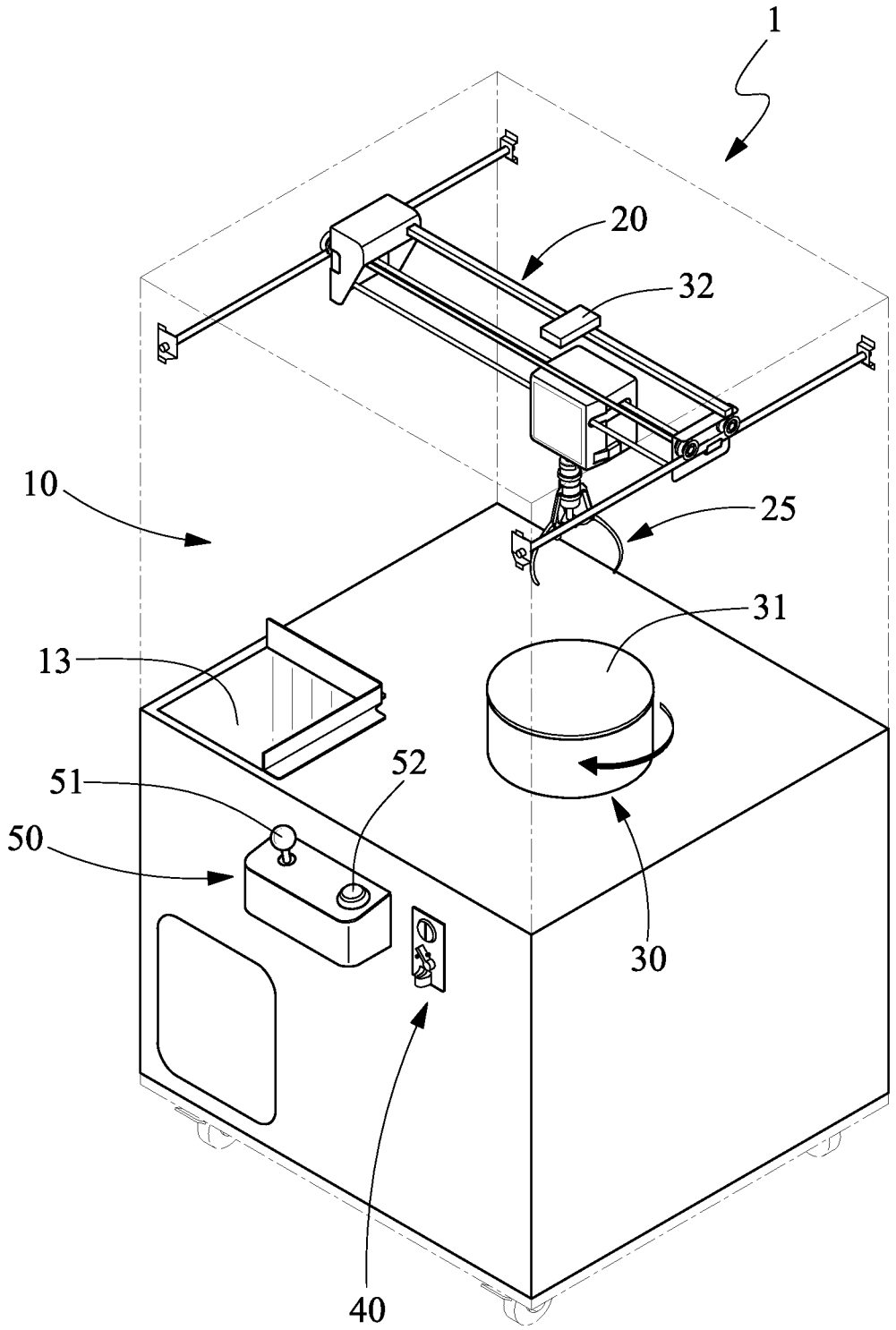
FIG. 3 is a perspective view of a claw machine according to the second embodiment of the present invention.
Figure 4:
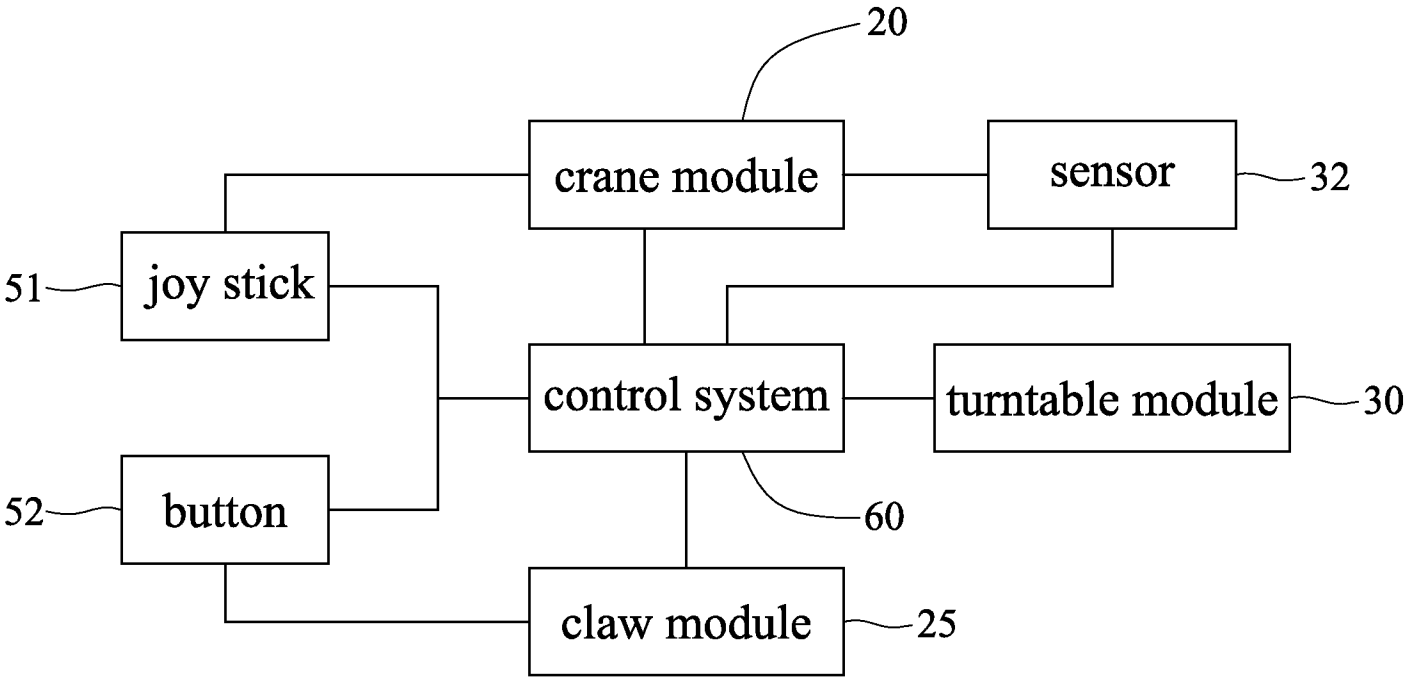
FIG. 4 is a block diagram of the claw machine shown in FIG. 3.

Referring to FIGS. 3 and 4, for a second operation, the claw machine 1 further includes a sensor 32 for determining whether the claw module 25 is in a predetermined location. The predetermined location is a location of the claw module 25 above the turntable 31 where a vertical line passes the claw module 25 and the turntable 31.

In a predetermined period of time, the joy stick 51 and the button 52 are used to operate the crane module 20 and the claw module 25 to fetch a desired one of the prizes 12 and then move the crane module 20 and the claw module 25 to the predetermined location. The sensor 32 detects the claw module 25 and then sends a signal of location to the control system 60.

On receiving the signal of location, the control system 60 actuates the turntable module 30 to rotate the turntable 31 at a constant rate or a changing rate, in a first direction, a second direction or alternately the first and second directions. The claw module 25 drops the desired prize 12 onto the turntable 31 in rotation. Then, the turntable 31 casts the desired the prize 12 in a centrifugal manner. The centrifugal cast of the desired prize 12 from the turntable 31 depends on the rate and direction of the rotation of the rotation of the turntable 31 and the size and center of gravity of the desired prize 12. The player can collect the desired prize 12 from the chute 13 if the desired prize 12 is cast into the chute 13.

To move the claw module 25, which fetches the desired prize 12, to the predetermined location, the control system 60 stops the operation module 50 from controlling the crane module 20 and the claw module 25 when the claw module 25 fetches the desired prize 12. Instead, the control system 60 operates the crane module 20 to move the claw module 25 to the predetermined location and opens the claw module 25 to drop the desired prize 12 onto the turntable 31 in rotation. Thus, the control system 60 guarantees dropping of the desired prize 12 onto the turntable 31 in rotation to continue the game.

Figure 5:
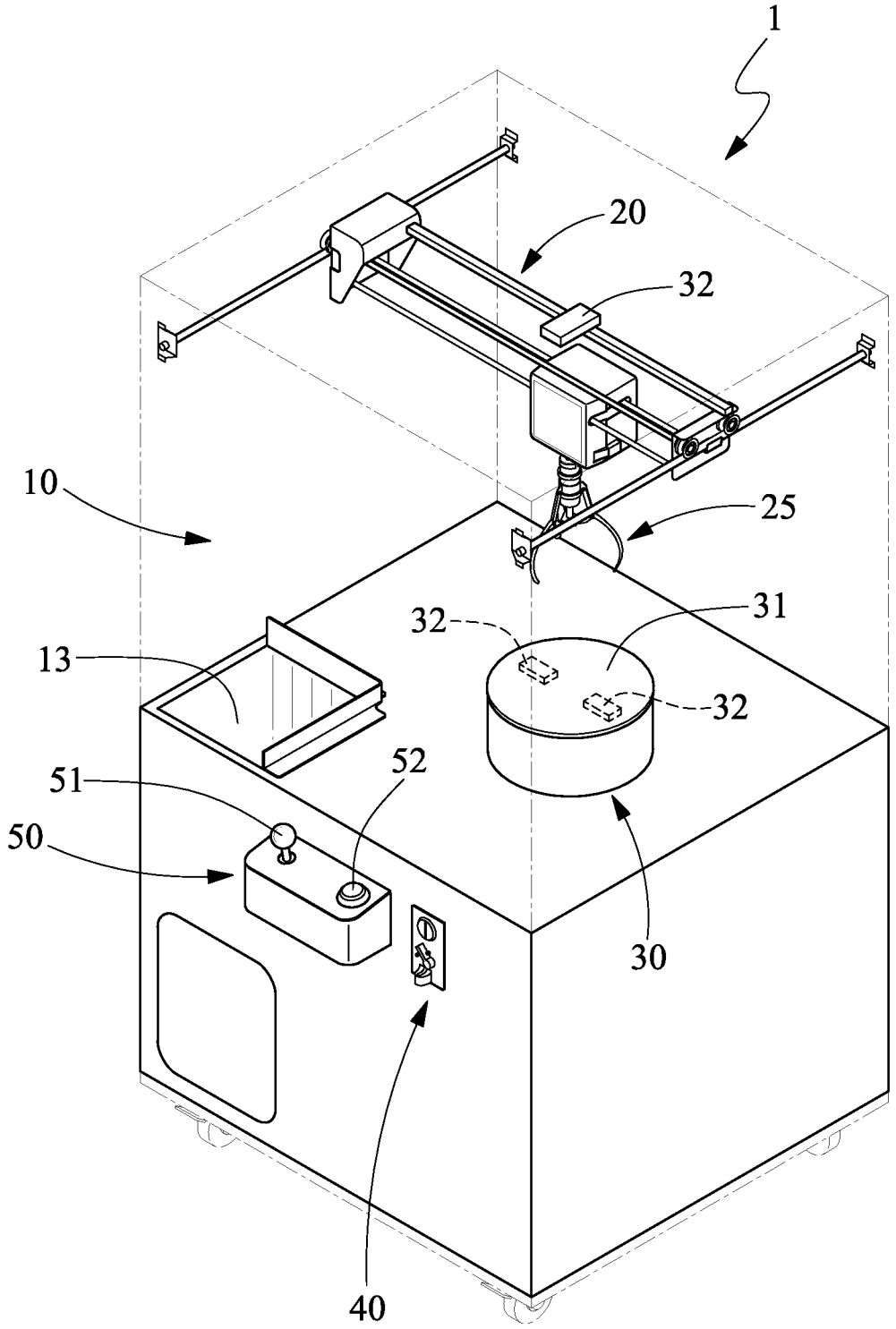
FIG. 5 is a perspective view of a claw machine according to the third embodiment of the present invention.
Figure 6:
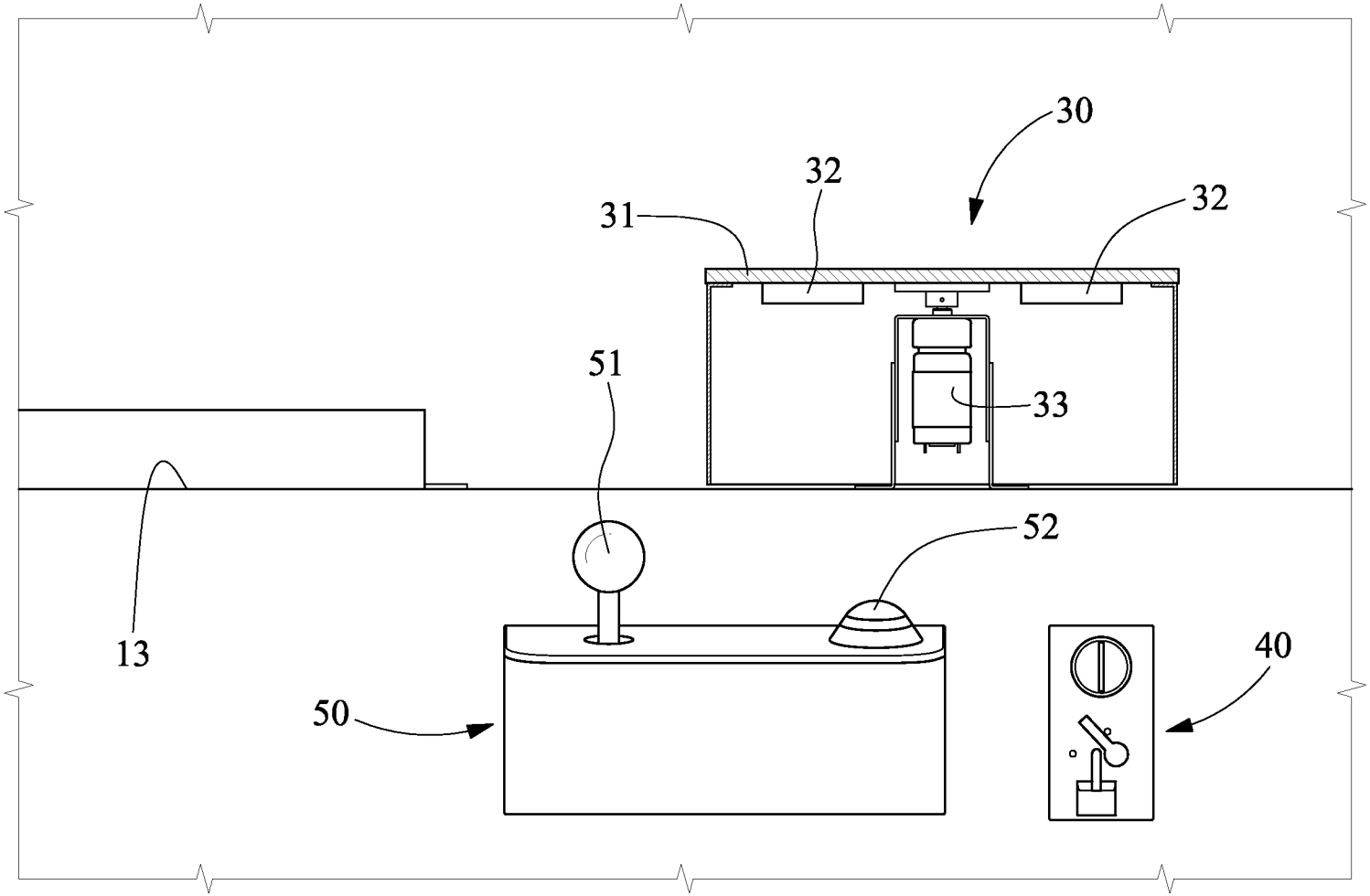
FIG. 6 is an enlarged partial front view of the claw machine shown in FIG. 5.
Figure 7:
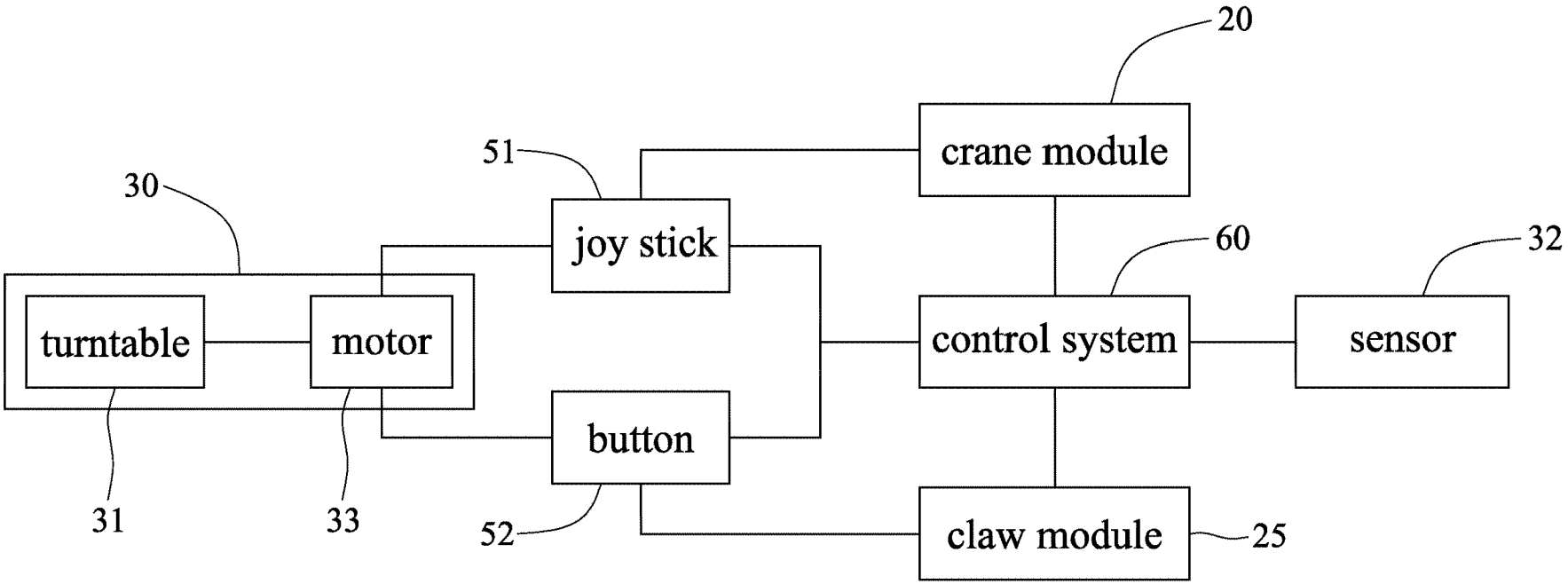
FIG. 7 is a block diagram of the claw machine shown in FIG. 5.

Referring to FIGS. 5 through 7, in a third operation, the coin module 40 receives at least one coin or token from a user and then sends a signal to the control system 60. On receiving the signal from the coin module 40, the control system 60 wakes the claw machine 1 from the stand-by mode.

After waking up the claw machine 1, the control system 60 hands control over the crane module 20 and the claw module 25 to the operation module 50. The joy stick 51 is operated to move the crane module 20. The button 52 is operated to lift or lower the claw module 25. Furthermore, the button 52 is operated to open or close the claw module 25. In a predetermined period of time, the joy stick 51 and the button 52 are operated to move the crane module 10, lift or lower the claw module 25 and open or close the claw module 25 to fetch a desired one of the prizes 12 and then drop the desired prize 12 onto the turntable 31 of the turntable module 30, which is now still.

To operate the claw module 25 to drop the desired prize 12 onto the turntable 31, when the claw module 25 fetches the desired prize 12, the control system 60 stops the operation module 50 from controlling the crane module 20 and the claw module 25. Instead, the control system 60 operates the crane module 20 and the claw module 25 to drop the desired prize 12 onto the turntable 31, which is still. Thus, the control system 60 guarantees dropping of the desired prize 12 onto the turntable 31 to continue the game.

The sensor 32 of the turntable module 30 determines whether the desired prize 12 is located on the turntable 31. If so, the sensor 32 sends a signal to the control system 60.

The sensor 32 can be a weight sensor, a raster sensor or an image sensor for example. The location of the sensor 32 is not limited to the one shown in the drawings.

On receiving the signal from the sensor 32, the control system 60 assigns the operation module 50 to control the turntable module 30 instead of the crane module 20 and the claw module 25. That is, the joy stick 51, which was originally assigned to control the crane module 20, is now assigned to control a motor 33 of the turntable module 30. Now, the joy stick 51 is operable to control the sense and rate of the rotation of the motor 33 and hence the turntable 31. Moreover, the button 52, which was originally assigned to lift or lower and open or close the claw module 25, is now assigned to actuate the motor 33 of the turntable module 30 before the control system 60 stops the motor 33 after several seconds.

The joy stick 51 can control the turntable module 30 in a first manner. The joy stick 51 is rotated clockwise to cause the motor 33 of the turntable module 30 and hence the turntable 31 to rotate in a first direction. Alternatively, the joy stick 51 is rotated counterclockwise to cause the motor 33 of the turntable module 30 and hence the turntable 31 to rotate in a second direction opposite to the first direction. The rate of the rotation of the joy stick 51 determines the rate of the rotation of the motor 33. To protect the motor 33, the rate of the rotation of the motor 33 is limited to a safe range. In this safe range, the joy stick 51 is used allowed to control the rate of the rotation of the motor 33. The turntable 31 and the motor 33 respond to commands and signals from the joy stick 51 and the button 52 in a sensitive and lag-free manner.

When the control system 60 assigns the joy stick 51 and the button 52 to control the turntable module 30, then player is allowed to use the button 52 to actuate the turntable module 30 and use the joy stick 51 to control the direction and rate of the rotation of the turntable module 30. The player uses his or her eyesight to measure the location of the desired prize 12 on the turntable 31, and accordingly determines the direction and rate of the rotation of the joy stick 51 to determine the direction and rate of the rotation of the turntable 31, which in turns rotates the desired prize 12. Eventually, the turntable 31 casts the desired prize in a centrifugal manner. The player can collect the desired prize 12 from the chute 13 if he or she successfully casts the desired prize 12 into the chute 13. Finally, the control system 60 stops the turntable module 30.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A method for operating a claw machine comprising a compartment for containing multiple prizes, a crane module movable in the compartment, a chute for transporting the prizes out of the compartment, a claw module movable up and down relative to the crane module in the compartment, a turntable module located in the compartment, a coin module for receiving at least one coin, a control system for waking up the claw machine on receiving a signal from the coin module, and an operation module comprising at least one joy stick and at least one button, wherein the method comprises:

using the control system to actuate the turntable module;

using the joy stick and the button to move the crane module, to lift and lower the claw module relative to the crane module, to close the claw module to fetch a desired one of prizes, and to open the claw module to drop the desired prize onto the turntable module; and using the turntable module to cast the desired prize toward the chute in a centrifugal manner.

2. The method according to claim 1, further comprising the steps of:

using the control system to stop the joy stick and the button from controlling the crane module and the claw module when the claw module; and using the control system to control the crane module and the claw module to drop the desired prize onto the turntable module.

3. A method for operating a claw machine comprising a compartment for containing multiple prizes, a crane module movable in the compartment, a chute for transporting the prizes out of the compartment, a claw module movable up and down relative to the crane module in the compartment, a turntable module located in the compartment, a sensor connected to the turntable module, a coin module for receiving at least one coin, a control system for waking up the claw machine on receiving a signal from the coin module, and an operation module comprising at least one joy stick and at least one button, wherein the method comprises:

using the joy stick and the button to move the crane module and to close the claw module to fetch a desired one of the prizes;

using the crane module to move the claw module a predetermined location where a vertical line passes the claw module and the turntable module;

using the sensor to send a signal of location to the control system on detecting the desired prize on the turntable;

using the control system to actuate the turntable module on receiving the signal of location;

using the claw module to drop the desired prize onto the turntable module; and using the turntable module to cast the desired prize toward the chute in a centrifugal manner.

4. The method according to claim 3, further comprising the steps of:

using the control system to stop the joy stick and the button from controlling the crane module and the claw module when the claw module fetches the desired prize; and using the control system to control the crane module to move the claw module to the predetermined location and to open the claw module to drop the desired prize onto the turntable module.

5. A method for operating a claw machine comprising a compartment for containing multiple prizes, a crane module movable in the compartment, a chute for transporting the prizes out of the compartment, a claw module movable up and down relative to the crane module in the compartment, a turntable module located in the compartment, a sensor connected to the turntable module, a coin module for receiving at least one coin, a control system for waking up the claw machine on receiving a signal from the coin module, and an operation module comprising at least one joy stick and at least one button, wherein the method comprises:

using the control system to instruct the operation module to control the crane module and the claw module;

using the joy stick to move the crane module;

using the button to lift and lower the claw module relative to the crane module, to close the claw module to fetch a desired one of the prizes, and to open the claw module to drop the desired prize onto the turntable module;

using the sensor to detect the desired prize on the turntable module and to accordingly send a signal to the control system;

using the control system to allow the button to be pushed to turn on and off the turntable module on receiving the signal; and using the control system to allow the joy stick to be operated to control a direction and rate of the rotation of the turntable module;

using the turntable module to cast the desired prize toward the chute in a centrifugal manner; and using the control system to stop the turntable module from rotation.

* * * * *